US005667183A

United States Patent [19]

Hiromori

[11] Patent Number: 5,667,183

[45] Date of Patent: Sep. 16, 1997

[54] PAPER HOLDER

[75] Inventor: Junji Hiromori, Tokyo, Japan

[73] Assignee: Hiromori Inc., Tokyo, Japan

[21] Appl. No.: 538,235

[22] Filed: Oct. 3, 1995

[51] Int. Cl.[6] ..... A47B 97/04

[52] U.S. Cl. ..... 248/451; 24/67.11; 40/652

[58] Field of Search ..... 248/451, 442.2, 248/316.5, 316.7; 24/67.11, 67 R, 531; 40/652, 658

[56] References Cited

U.S. PATENT DOCUMENTS

| | | | |
|---|---|---|---|
| 2,006,887 | 7/1935 | Doherty | 248/442.2 X |
| 3,398,475 | 8/1968 | Palmer | 40/658 |
| 4,097,971 | 7/1978 | Moris | 40/658 X |
| 4,261,121 | 4/1981 | Coon | 40/658 X |
| 5,335,399 | 8/1994 | Chou | 24/67 R X |
| 5,479,682 | 1/1996 | Hendrikx et al. | 24/67.1 |

*Primary Examiner*—Ramon O. Ramirez

*Attorney, Agent, or Firm*—Dilworth & Barrese

[57] ABSTRACT

The present invention discloses an improved paper holder for holding paper or the like in a bundle in operating a word processor, a typewriter or a computer. The paper holder is constituted in a manner such that two holding members made of synthetic resins provided with a convex holding surface at the front end of one of the holding members and a concave holding surface in conformity with the configuration of the convex holding surface formed at the other front end of the holding members are arranged to constitute a holding part by contacting the two holding surfaces together, two spindles being mounted at a base extended form a lower end of the holding member with the convex holding surface so as to separate the other holding member with a concave holding surface by pushing the end of said concave holding member down with a finger, and an elastic member for contacting the holding surfaces together under pressure due to bias of the elastic body, thereby holding paper in a standing and somewhat curved state along with the configuration of the holding members.

15 Claims, 7 Drawing Sheets

PAPER HOLDER

FIELD OF THE INVENTION

The present invention relates to a paper holder for holding paper or the like; and more particularly relates to a paper holder for holding a sheet of paper or a plurality of sheets of paper in its standing and somewhat curved states whereby it is easy to see in operating a word processor, a typewriter or a personal computer or the like as a draft.

BACKGROUND OF THE INVENTION

A conventional paper holder for holding paper or the like merely holds a sheet of paper or a plurality of sheets of paper in a bundle without dispersing said paper and provided with two holding plates with each linear holding surface arranged at the front end portions of said holding plates. An elastic body for contacting the holding surfaces together due to bias of said elastic body is mounted.

However, since the conventional paper holder merely aims at holding paper or the like between two holding surfaces of said paper holder without dispersing held paper, it is impossible to arrange a position easy to see said paper or a plurality of sheets of paper in operating a word processor, a typewriter or a personal computer and further impossible to provide a condition whereby it is easy to see said draft without turning up or bending due to wind.

Furthermore, it may be considered that paper as a draft is hung or placed on a desk top or the like in a standing position in order not only to provide a condition whereby it is easy to see the draft, but also hold a plurality of sheets of paper in a bundle. According to the former method, however, it is difficult to find a suitable place to hang down a paper holder and further a separate member for holding down the draft becomes necessary and still further the draft hung down is easily turned up imprudently due to wind. According to the latter, on the other hand, it is not so difficult to find a suitable place where the paper holder is placed, but it is necessary to provide a means for keeping the draft in its standing position and further the draft thus held in its standing position is apt to be bent due to wind or the weight of said draft itself because of a linear configuration of the holding surface. Therefore, it was impossible to provide or arrange a condition whereby it is easy to see the held draft in a bundle.

SUMMARY OF THE INVENTION

The present invention seeks to overcome the aforementioned conventional defects by providing an improved paper holder.

It is an object of the present invention to provide a paper holder; the object can be attained by the paper holder described hereinafter.

A paper holder comprising:

two holding members made of synthetic resins provided with a convex holding surface at the front end of one of said holding members and a concave holding surface in conformity with the configuration of said convex holding surface formed at the other front end of said holding members being arranged to constitute a holding part by contacting said two holding surfaces together;

two spindles being mounted at a base portion extended from a lower end of said holding member with the convex holding surface so as to separate the other holding member with a concave holding surface by pushing the end portion of said concave holding member down with a finger; and an elastic member for contacting said holding surfaces of the convex and concave holding members together under pressure due to bias of said elastic body, thereby holding paper or the like in its standing and somewhat curved state along the configurations of said holding members. Thus, a sheet of paper or a plurality of sheets of paper may be kept in its standing state for a long time just as holding it by the hand without bending imprudently.

Following are various aspects of the paper holder according to the present invention:

A paper holder comprising:

a lower end of either holding member being extended from in a direction of almost a right angle or lower ends of said holding members being extended in a direction of almost a right angle therewith, thereby forming a leg portion for retaining a standing state of said holding members.

A paper holder comprising:

either one of a holding member being connected pivotably free to the surface of a leg portion of the other holding member constituting the leg portion by extending the end portion of the holding member in a direction of almost a right angle. Thus, it becomes possible to hold a sheet of paper or the like with ease by pushing one of said holding members down while putting or placing the paper holder on a desk top without holding up the paper holder itself. The end of the held paper or the like is placed onto the surface of said leg portion always in its standing state without any slip.

One of the holding members according to the present invention is connected through a spindle to a wall surface of the other holding member forming a leg portion by extending a lower end of the holding member in a direction of almost a right angle therewith. Thus, it becomes possible to hold a sheet of paper or the like while placing the paper holder on a desk top by merely nipping both sides of said holding members with the fingers. The nipping force is comparatively smaller than that caused by nipping either one of the holding member only.

According to the present invention, a placing member for placing a lower end of a sheet of paper or the like disposed at a position higher than that of a spindle for connecting the holding members mounted at either one of the holding members, is mounted at either one of the holding members provided with leg portions extended in a direction of almost a right angle.

According to the present invention, a placing member for placing the end of a sheet of paper or the like disposed at a position higher than that of a spindle for connecting the holding members, is mounted at the wall or the surface of the leg portion of either one of the holding members extended in a direction of almost a right angle.

According to the present invention, both lower ends of the holding members are extended toward the outside in a direction of almost rigfjht angle to form a leg portion or either one of said lower ends is extended toward the outside in a direction of almost a right angle to form the leg portion and one of the holding members is connected pivotably free to a wall of the other holding members. Further, a placing surface for placing a lower end of paper to be held, is arranged on a projecting portion provided with a spindle of either one of the holding means. Thus, a lower end of paper or the like to be held does not directly contact the spindle portion for connecting the holding members and further said paper or the like is not damaged due to the operation of said holding members.

A fixing member for fixing firmly the holding members such as a weight, magnet or a suction disk is mounted at the base of the leg portion in order to prevent said holding members from falling down. Thus, even when the center of gravity of the holding members becomes higher by holding paper or the like therebetween, it can prevent falling down of the holding members due to the fixation onto a desk top, etc.

The concave holding surface of the holding members of the present invention is arranged to incline backward to some degree. That is to say, paper or the like to be held is curved in the forward direction and at the same time inclines in the backward direction, thereby maintaining said paper or the like in a position easy to see in operating a word processor, a typewriter or a personal computer.

DESCRIPTION OF THE PREFERRED EMBODIMENTS

Hereinafter, embodiments according to the present invention will be described in detail with reference to the accompanying drawings.

Figure 1:
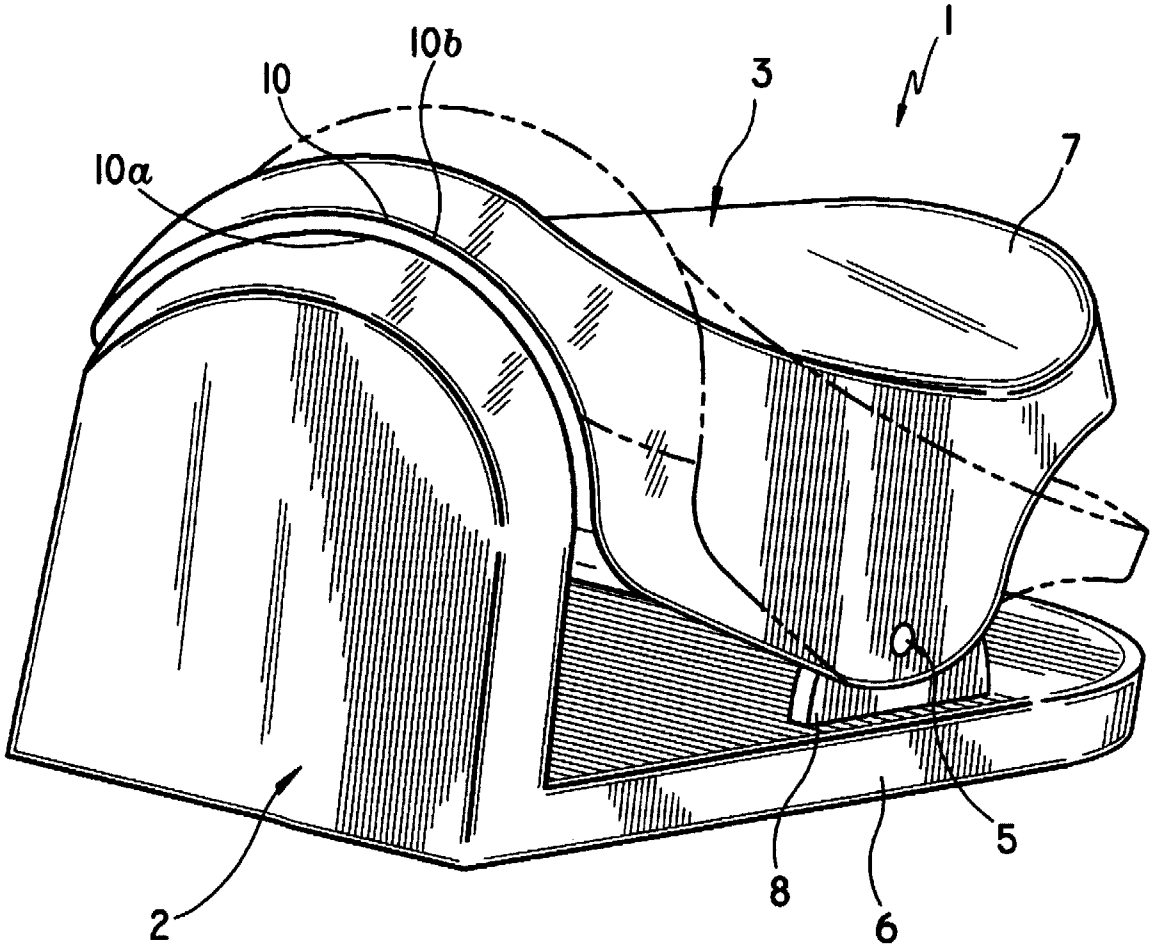
FIG. 1 is a perspective view of a paper holder according to the present invention.
Figure 2:
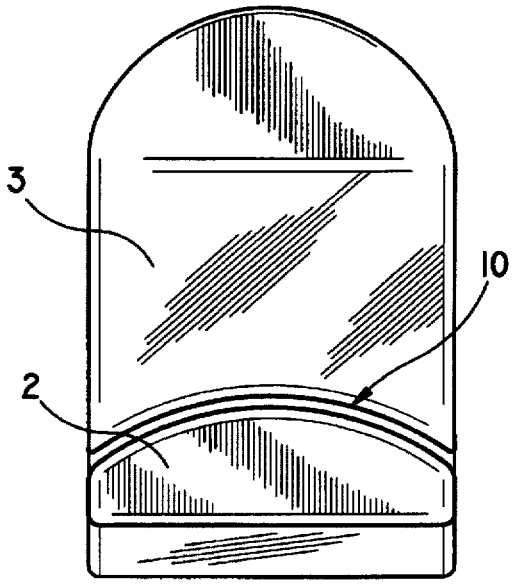
FIG. 2 is a plan view of said paper holder.
Figure 3:
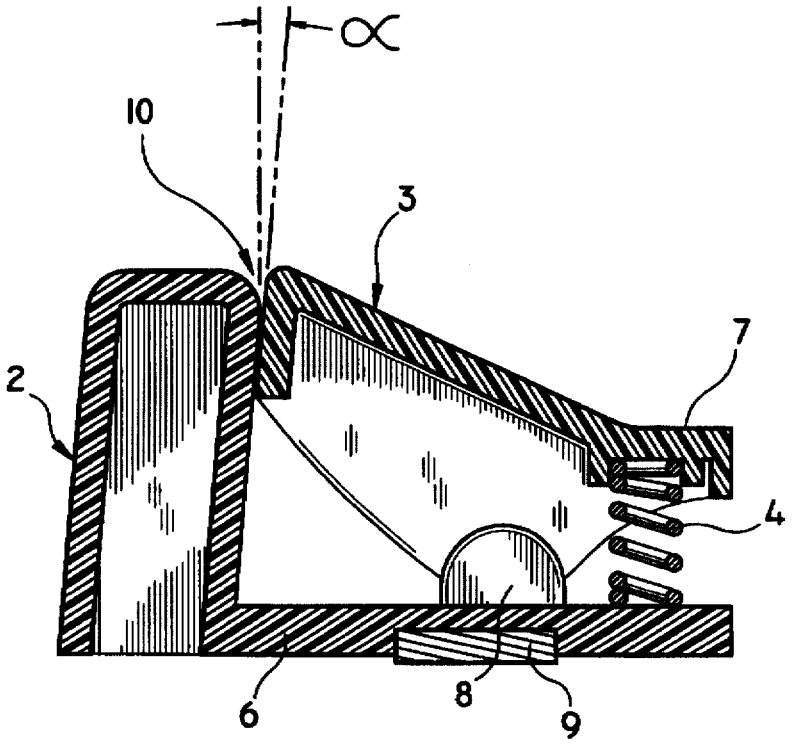
FIG. 3 is a sectional view showing a construction of said paper holder.

As illustrated in FIGS. 1 through 3, a paper holder according to the present invention comprises the following constitutional elements.

A convex holding member (2) made of synthetic resins provided with a convex holding surface (10*a*) at the front end of said member (2), and further a leg portion (6) extended from a lower end portion of said member (2) in a direction of almost a right angle and a concave holding member (3) made of synthetic resins provided with a concave holding surface (10*b*) at the front end of said member (3) having the configuration in conformity with said holding surface (10*a*) of the holding member (2), are arranged to form a holding part (10) by putting said holding surfaces (10*a*, 10*b*) together. By pushing down an operating portion (7) in the vicinity of the end of said concave holding member (3) with a finger, for example with the thumb, the holding surface (10*b*) of said concave holding member (3) separates from the holding surface (10*a*) of said convex holding member (2) so as to open the holding part (10). Both sides of said concave holding member (3) are connected pivotably free upon at least one axis 5. through two spindles (8) mounted at a projecting portion provided with the spindles at the leg portion (6) extended from a lower end of the holding member (2) in a direction of almost a right angle. Furthermore, a coil spring (4) as an elastic body is disposed in between the convex and concave holding members (2,3) so as to press said holding surfaces (10*a*, 10*b*) together due to bias of said elastic body.

Figure 4:
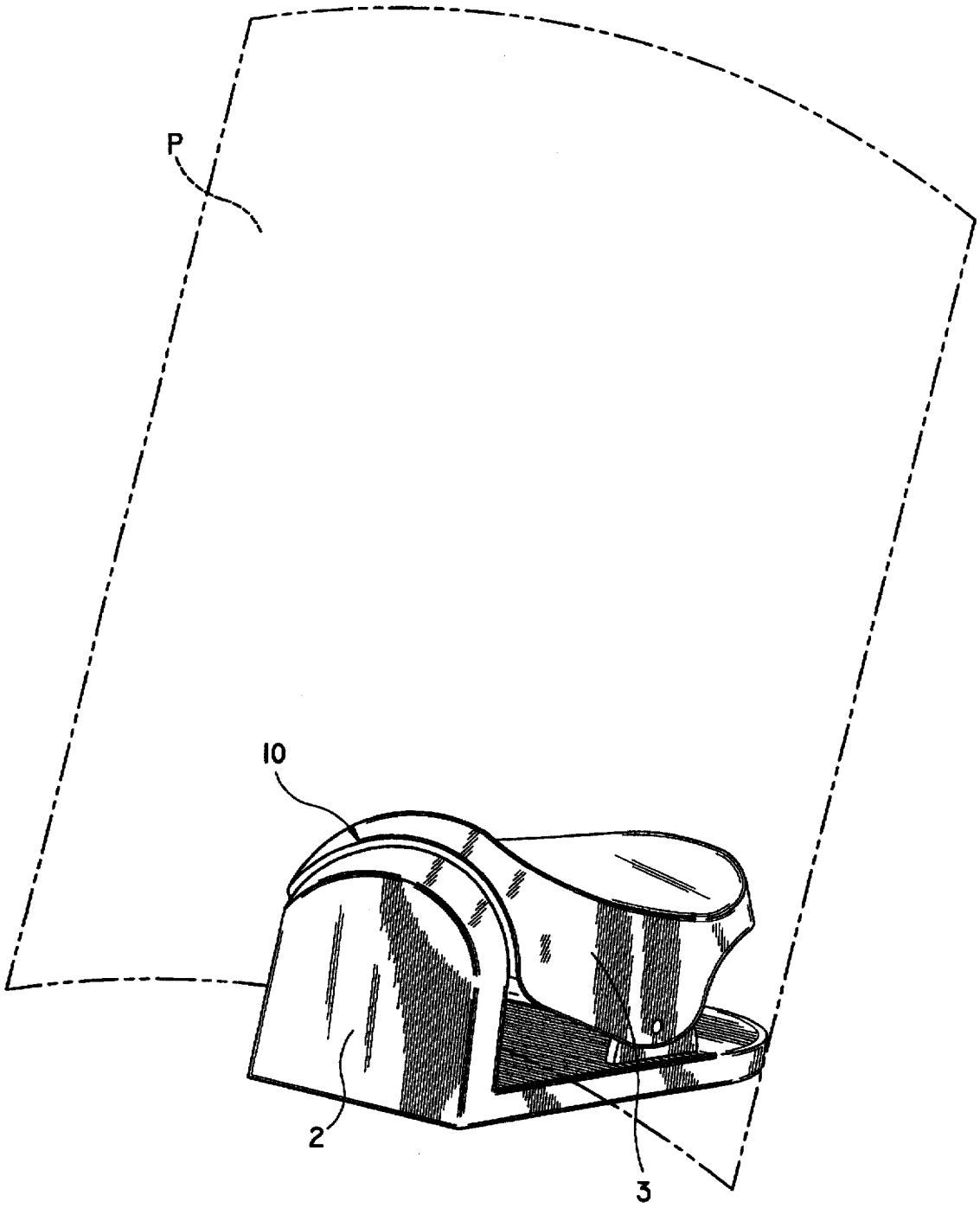
FIG. 4 is a perspective view for explaining use, of an embodiment of said paper holder.

As illustrated in FIG. 4, when a sheet of paper (P) or the like is held at the holding part (10) in its standing state said paper or the like is kept in its standing and somewhat curved state along the configuration of said holding part.

As illustrated in FIG. 3, the holding part (10) is formed in a manner such that the concave holding surface in the frontward direction is inclined at an angle of $\alpha$ in the backward direction. That is to say, by keeping paper or the like to be held in an inclined situation, the condition whereby it is easy to see said paper or the like as a draft may be provided in operating a word processor, etc., and, at the same time, falling down of the draft in the frontward direction can be prevented. Because the curvature of said draft is made in the frontward direction and therefore falling down in the backward direction is hardly occurs. Furthermore, the curvature may give a condition whereby it is easy to see the held paper or the like as a draft.

Figure 5:
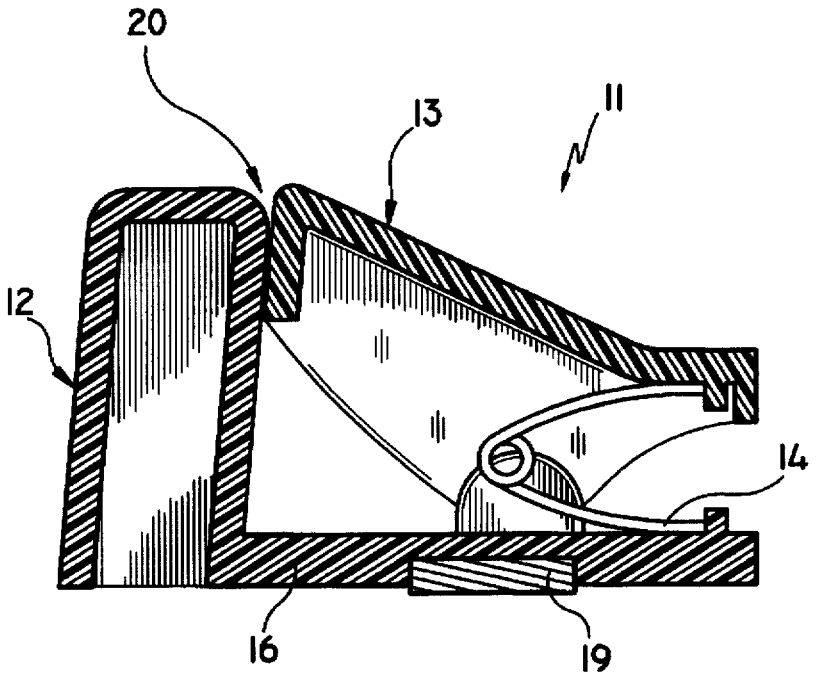
FIG. 5 is a sectional view showing another embodiment of an elastic body according to the present invention.

Regarding an elastic body for biasing the holding surfaces to contact together under pressure, a wound coil spring (14) arranged in a lateral direction may be employed as illustrated in FIG. 5 in addition to a wound coil spring (4) arranged in a vertical direction so as to press the holding members (12,13) together at a holding part (20) due to bias of said springs.

Figure 6:
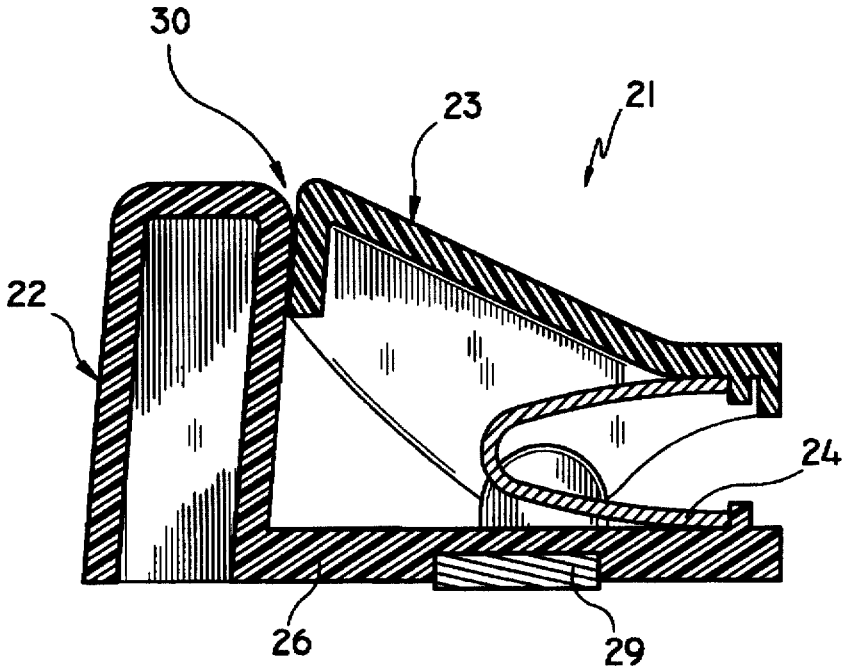
FIG. 6 is a sectional view showing another embodiment of an elastic body of the present invention.

As illustrated in FIG. 6, a slender spring (24) in the shape of a U as an elastic body may also be employed so as to contact two holding members (22,23) at a holding part (30) under pressure.

Furthermore, the leg portion (6) formed at a lower end of the convex holding member (2) is constituted by bending said lower end of said member (2) to extend in almost a right angle so as to keep the holding part (10) in an upward direction on a desk top. Said leg portion may be lengthened or widened so as to place firmly the holding members on a desk top, etc., for preventing from falling down when paper (P) or the like is held at the holding part (10). A fixing member (9) such as stone, iron, a weight or magnet, etc., may be disposed at the base of the leg portion (6) for securing better stability of the holding members.

Figure 7:
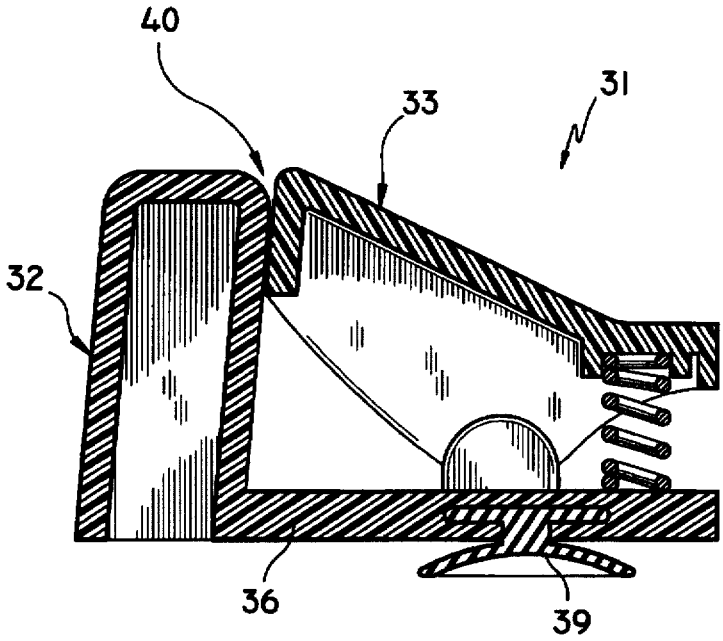
FIG. 7 is a sectional view showing another embodiment of a fixing member according to the present invention.

As illustrated in FIG. 7, a suction disk (39) may also disposed at the base of a leg portion (36), if desired.

Figure 8:
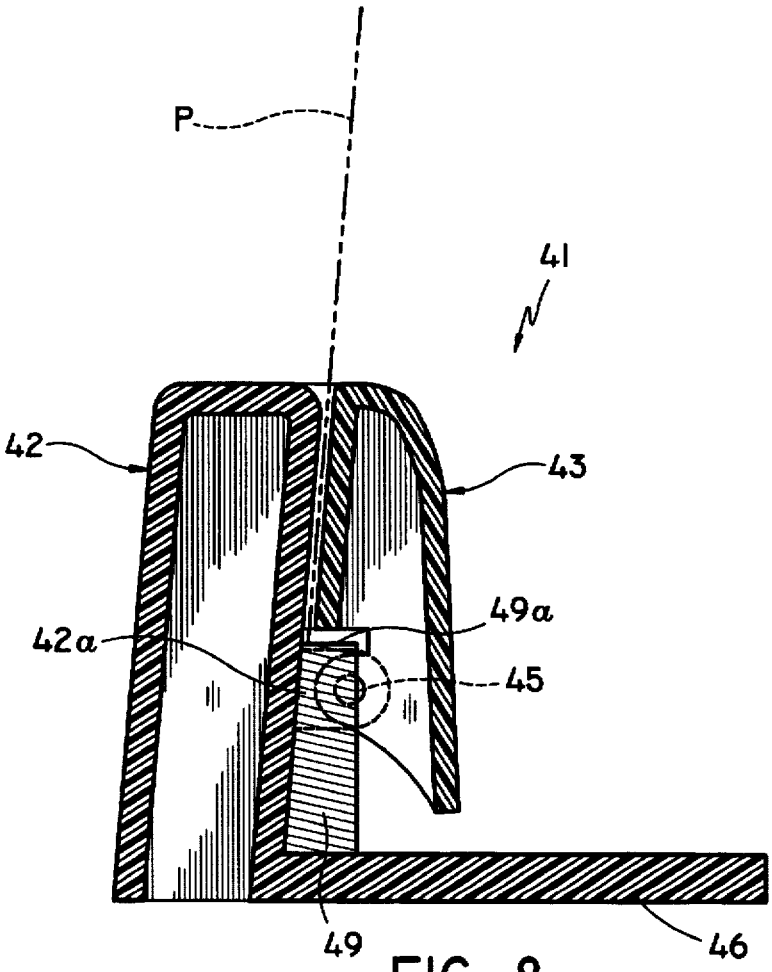
FIG. 8 is a sectional view showing another embodiment of the present invention.
Figure 9:
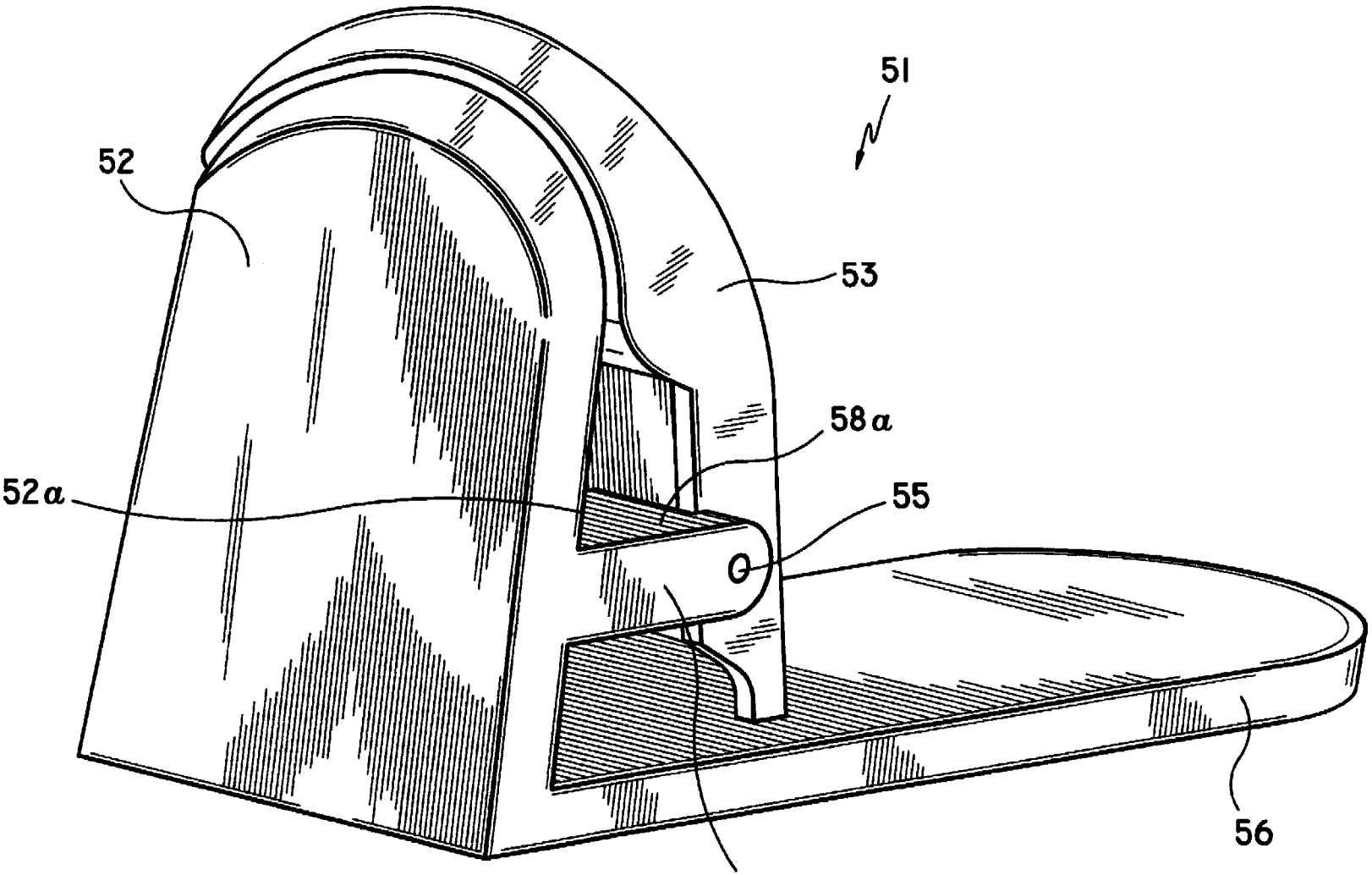
FIG. 9 is a perspective view showing still another embodiment of the present invention.

As illustrated in FIG. 8, as another embodiment of the present invention, a base (46) is formed by extending a lower end of a holding member (42) in a direction of almost a right angle and further the other holding member (43) is connected pivotably free to a wall (42*a*) of said holding member (42) through a spindle (45). Further, a placing member (49) provided with a placing surface (49*a*) is disposed at a position higher than that of a spindle (45) for connecting the holding members for holding a lower end of paper (P) to be held. Also, as illustrated in FIG. 9, a leg portion (56) is formed by extending a lower end of a holding member (52) in a direction of almost a right angle and further a placing surface (58*a*) for placing a lower end of paper or the like to be held at an upper surface of a projecting portion (58) provided with a spindle; mounted at a wall surface (52*a*) of a holding member (52) and to which the other holding member (53) mounted for connecting said two members (52,53) through a spindle (55) is disposed at a position higher than that of a spindle portion (55) for connecting both members (52,53). Thus, compared with pressing force for pressing only one of the holding members, it becomes possible to cause smaller pressing force and there is no fear of damaging paper or the like even when both of the holding members are operated by pressing both sides thereof with fingers.

Figure 10:
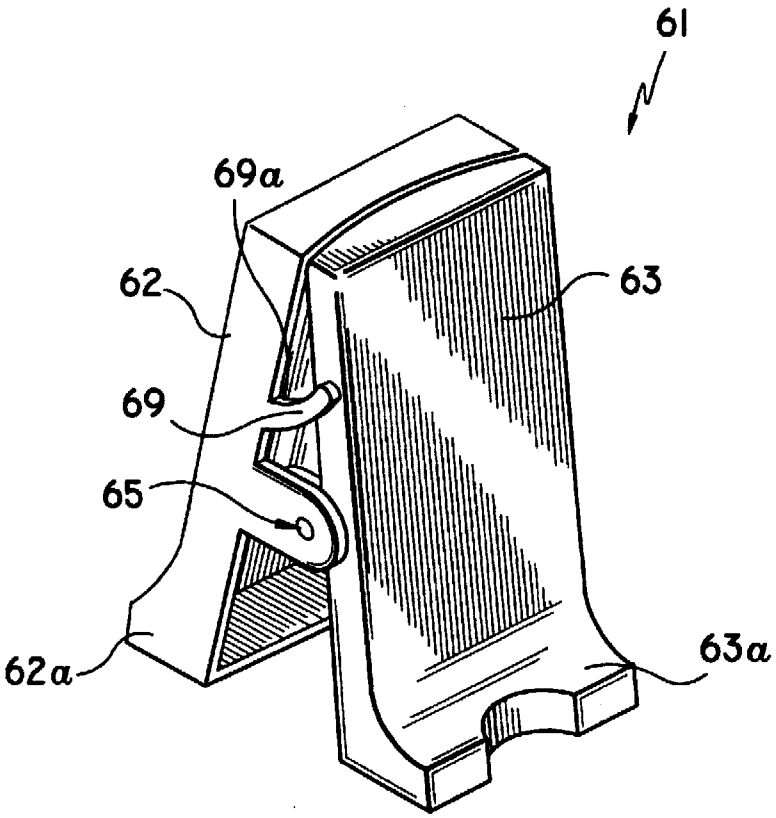
FIG. 10 is a perspective view showing still further another embodiment of the present invention.

As illustrated, in FIG. 10, regarding another embodiment of the present invention, leg portions (62*a*, 63*a*) are formed by extending lower ends of holding members (62,63) provided with toward the outside. A placing piece (69) for placing a lower end of paper is disposed at a position higher than that of a spindle portion (65) for connecting the holding members (62,63).

Figure 11:
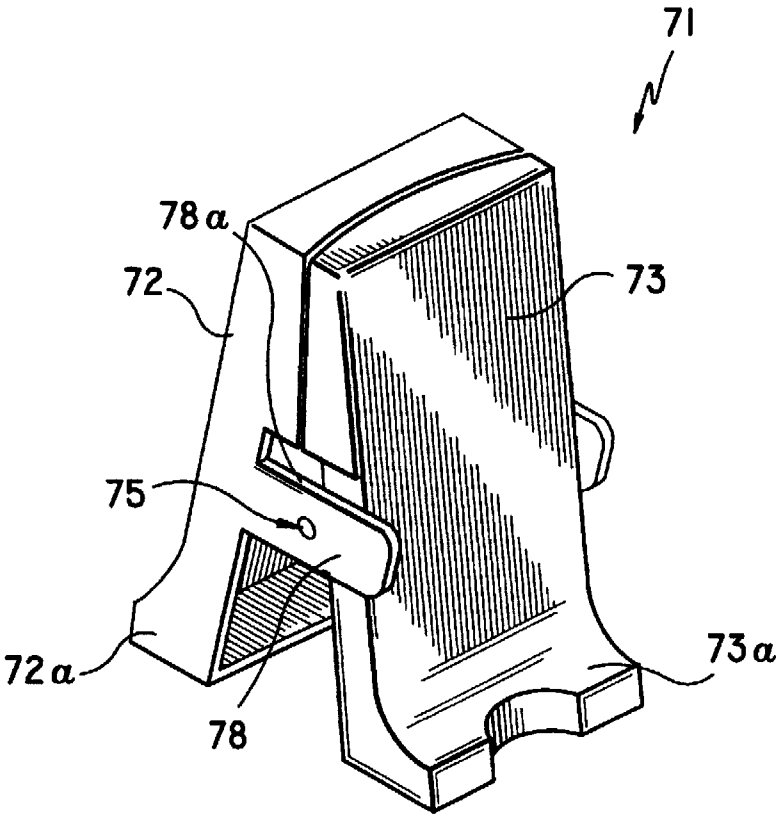
FIG. 11 is a perspective view showing still another embodiment of the present invention.

As illustrated in FIG. 11, leg portions (72*a*,73*a*) are formed by extending lower ends of holding members (72, 73) toward the outside in a direction of almost a right angle. A projecting portion (78) provided with the spindle for connecting the other holding member pivotably free is mounted at the wall surface of one of said holding members (72,73).

A placing surface (78*a*) for placing a lower end of paper held is disposed at a position higher than that of a spindle portion (75) for connecting the holding members pivotably free. Thus, it is possible to maintain paper to be held in its somewhat curved and standing state as in aforementioned cases even when one of the lower ends of the holding members are formed in a configuration easy to form without forming almost a right angle. At that time, it is of course possible to hold paper or the like in its somewhat curved and standing state without causing any fear of damaging the held paper or the like.

The paper holder according to the present invention may also be employed in holding a price list or a cooking guide for cooking or seasoning food or the like.

As described hereinabove, according to the paper holder of the present invention, it is possible to hold a sheet of paper or a plurality of sheets of paper in a bundle in its standing state with somewhat curvature without causing falling down by a simple means just as holding it with the fingers and further is possible to give a favorite condition in operating a word processor, a typewriter or a personal computer without any necessity of preparing a particular member to operate the word processor, etc.

Still furthermore, it is possible to prevent the reflection of the sunshine or illumination on the surface of paper and therefore a favourable condition whereby it is easy to see can be obtained.

What is claimed is:

1. A paper holder, comprising two holding members, a first holding member provided with a convex holding surface and a second holding member provided with a substantially complementary concave holding surface, a base portion extending from a lower end of one of said first and second holding members, two spindles provided on either said base portion or a wall portion of said one holding member and upon which the other of said first and second holding members is pivotally mounted, such that said other holding member can be separated from said one holding member by pushing an end portion of said other holding member with a finger, and an elastic member arranged to bias said holding surfaces of said first and second holding members together under pressure, whereby paper situated between said two holding surfaces is retained in an erect and somewhat curved state.

2. The paper holder of claim 1, wherein said first holding member provided with said convex holding surface comprises said base portion and said second holding member provided with said substantially complementary concave holding surface is pivotally mounted thereon.

3. The paper holder of claim 1, wherein said base portion extends in a direction at a substantially right angle to said lower end of said one holding member, forming a leg portion to maintain said holder in upright position.

4. The paper holder of claim 3, additionally comprising a base portion extending from a lower end of said other holding member in a direction at a substantially right angle to said lower end of said other holding member, forming respective leg portions for firmly maintaining said respective holding members in upright position.

5. The paper holder of claim 3, wherein said spindles are provided on said base portion of said one holding member, with said other holding member being pivotally mounted thereon.

6. The paper holder of claim 1, wherein said spindles are provided on said wall portion of said one holding member, with said other holding member being pivotally mounted thereon.

7. The paper holder of claim 6, wherein said one of said two holding members additionally comprises means for maintaining a lower end of paper placed between said two holding surfaces at a level higher than a level of said spindles.

8. The paper holder of claim 7, wherein said means comprise an upper surface of a projection portion provided with said spindles and formed on said one holding member.

9. The paper holder of claim 1, wherein said one of said two holding members additionally comprises means for maintaining a lower end of paper placed between said two holding surfaces at a level higher than a level of said spindles.

10. The paper holder of claim 9, wherein said means comprise an upper surface of a projection portion provided with said spindles and formed on either one of said two holding members.

11. The paper holder of claim 1, additionally comprising means for stabilizing said holding members to prevent the same from falling down or over.

12. The paper holder of claim 11, wherein said means comprise a weight, magnet or suction disk.

13. The paper holder of claim 1, wherein said concave holding surface is configured to incline somewhat backwardly from a frontward direction thereof.

14. The paper holder of claim 1, wherein said elastic member is a coil spring arranged in either a lateral or vertical direction or a slender spring substantially in the shape of a U.

15. The paper holder of claim 1, wherein said first and second holding members are made of synthetic resin.

* * * * *